United States Patent [19]

Pohl

[11] Patent Number: 4,997,104

[45] Date of Patent: Mar. 5, 1991

[54] CONTAINER RECLOSING APPARATUS AND METHOD

[75] Inventor: Russell A. Pohl, Sioux Falls, S. Dak.

[73] Assignee: Bedford Industries, Inc., Worthington, Minn.

[21] Appl. No.: 389,125

[22] Filed: Aug. 3, 1989

[51] Int. Cl.[5] ..... B65D 33/30

[52] U.S. Cl. ..... 220/403; 24/30.5 R; 24/563; 229/87.09; 383/43; 383/90; 493/213

[58] Field of Search ..... 24/30.5 R, 563, 545; 383/43, 89, 49, 90; 229/87.09; 220/403; 493/213; 222/99, 101, 103, 107

[56] References Cited

U.S. PATENT DOCUMENTS

| | | | |
|---|---|---|---|
| 1,357,496 | 11/1970 | Grundy | 383/43 |
| 1,898,171 | 9/1927 | Bunnell | 206/522 |
| 1,903,839 | 10/1929 | Royal | 206/522 |
| 2,012,275 | 5/1932 | Hescher | 383/89 |
| 2,040,443 | 5/1936 | Pashoian | 24/547 |
| 2,845,976 | 8/1958 | Miller | 150/52 |
| 2,868,254 | 5/1956 | Saad | 206/522 |
| 2,884,980 | 5/1956 | Miller | 150/39 |
| 2,922,568 | 1/1960 | Harker | 206/260 |
| 3,028,899 | 4/1962 | Hubl | 383/89 |
| 3,141,221 | 7/1964 | Faulls | 24/30.5 R |
| 3,166,195 | 1/1965 | Taber | 211/49 |
| 3,201,030 | 3/1964 | Pollack | 206/522 |
| 3,259,302 | 7/1966 | Rocchisani | 24/30.5 R |
| 3,401,837 | 9/1968 | Wiedeman | 222/107 |
| 3,712,463 | 1/1973 | Bestehorn | 206/65 R |
| 3,815,794 | 6/1974 | Carlisle | 222/491 |
| 4,184,596 | 1/1980 | Avery | 206/522 |

FOREIGN PATENT DOCUMENTS

| | | | |
|---|---|---|---|
| 3736237 | 5/1989 | Fed. Rep. of Germany | 383/49 |

*Primary Examiner*—Stephen P. Garbe
*Attorney, Agent, or Firm*—Kinney & Lange

[57] ABSTRACT

A closure apparatus which includes a scroll-like closure panel of flexible material is used to resealably close the open end of a bag-like container. The closure panel has opposite inner and outer longitudinal edges, with its outer edge spirally wound about its inner edge. The closure panel is biased to define a coil in lateral section when the panel is in equilibrium. For closing the open end of the bag-like container, the end edges of an open end of the bag-like container are spirally captivated within the coil defined by the closure panel.

27 Claims, 13 Drawing Sheets

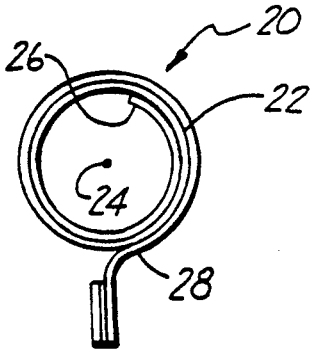
Fig. 1A
Fig. 1B
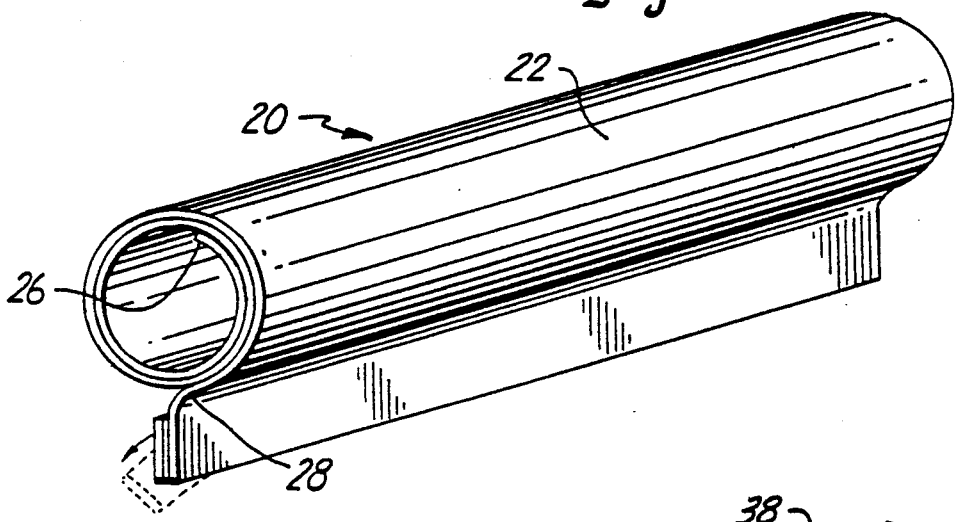
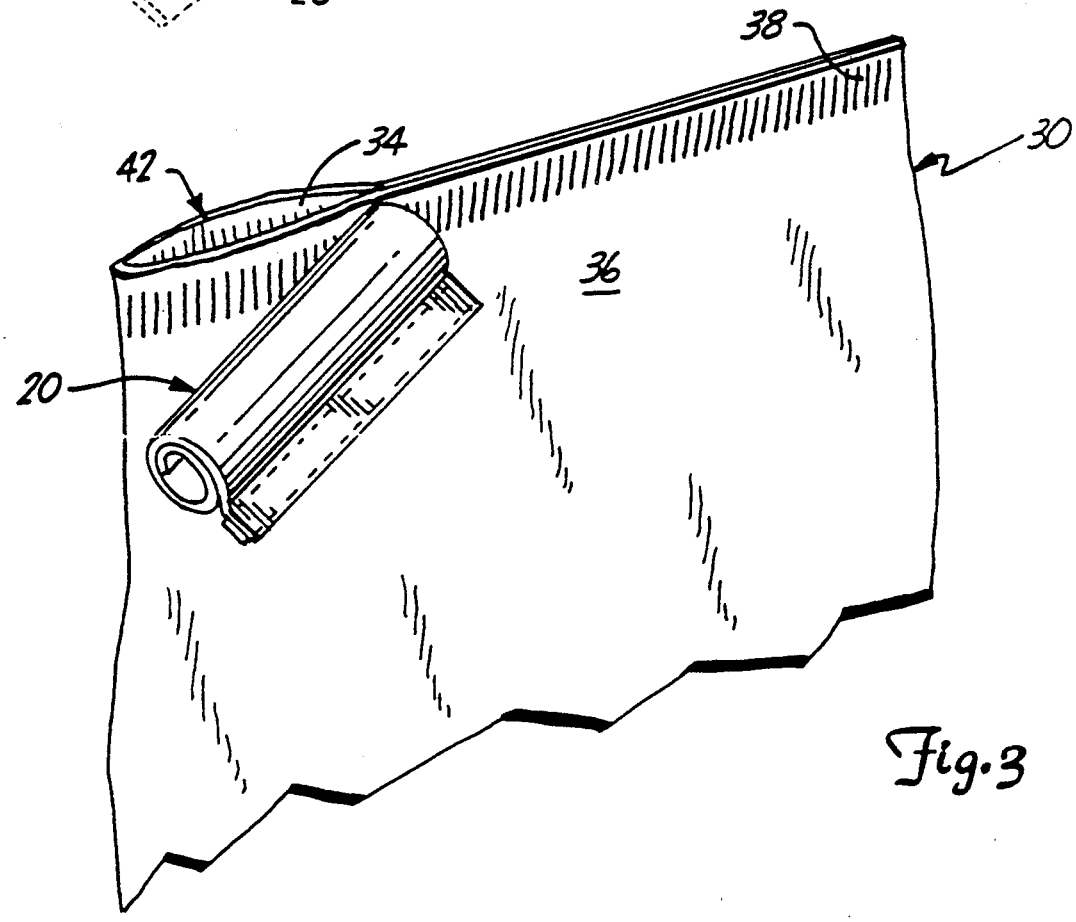
Fig. 3

20
22
34
36
35
37
60
28
40
30

34
20
26
35
22
36
37
28
40
60
30

26
37
22
35
20

34
36
28
40
60
30

20
22
50
52
62
40
60

63
222
220
FRESH
FOODS CORPORATION
240
64
30

Fig. 8
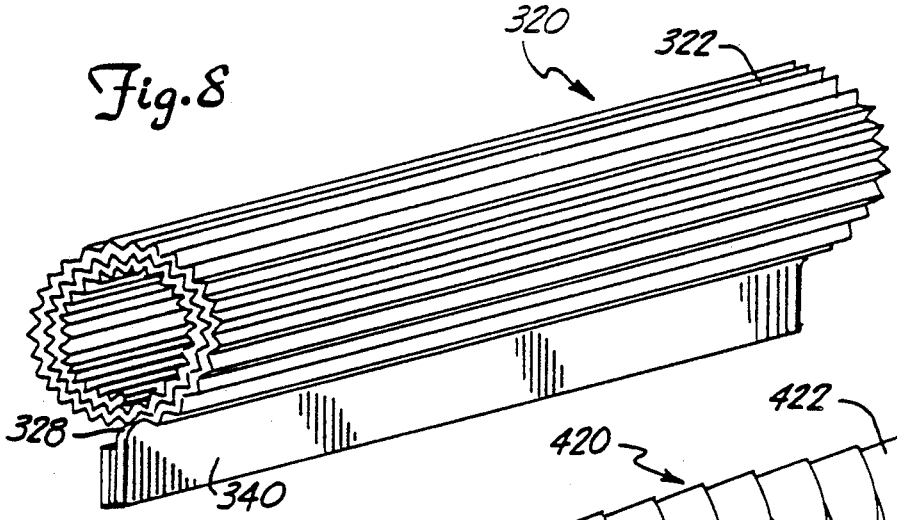
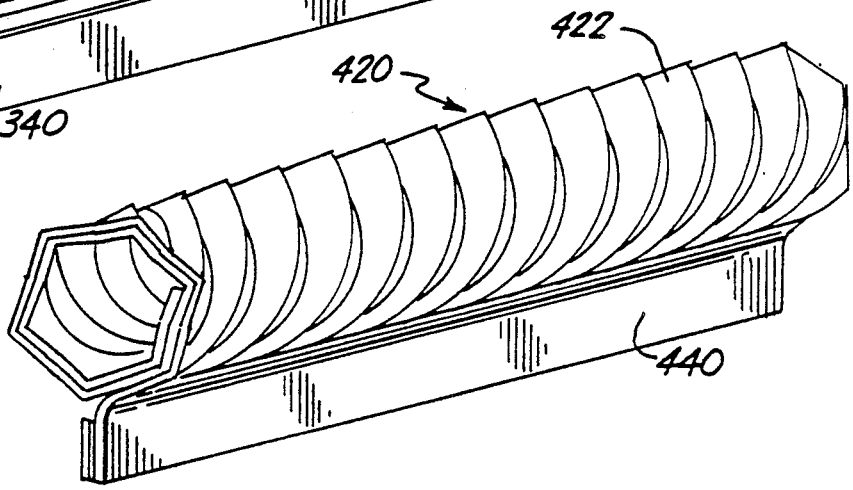
Fig. 9A
Fig. 9B
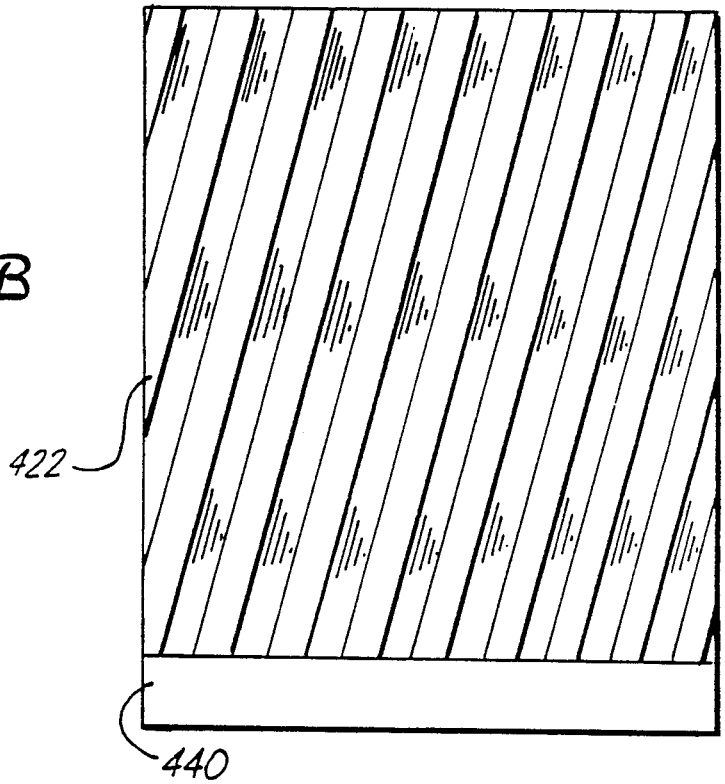

Fig. 11
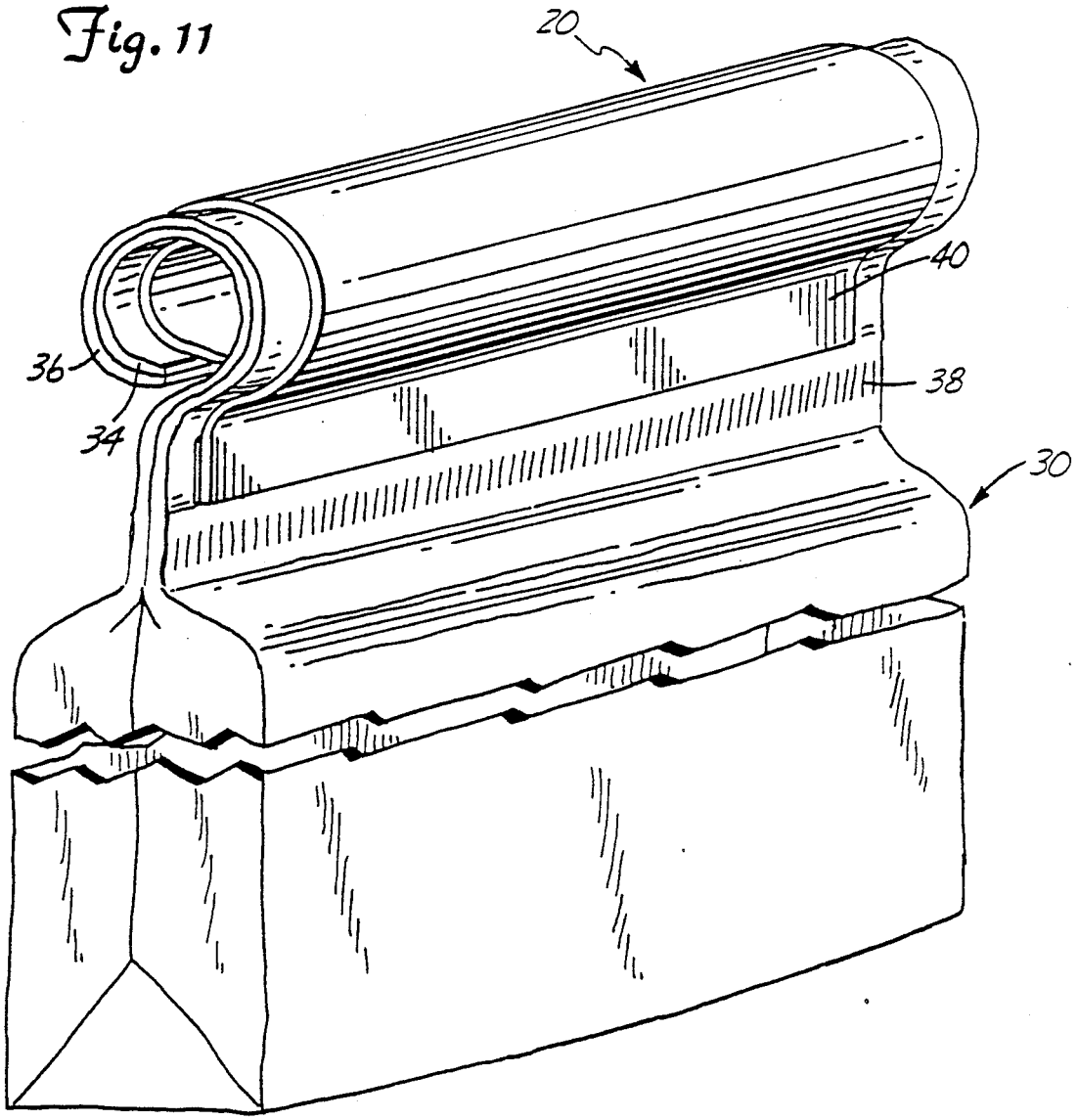
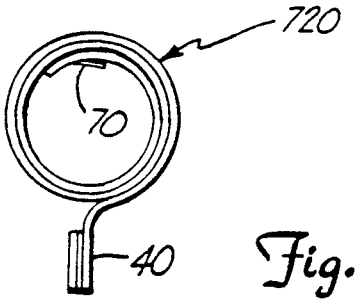
Fig. 12A

CONTAINER RECLOSING APPARATUS AND METHOD

FIELD OF THE INVENTION

The present invention relates to an apparatus and method for resealably closing a flexible open end of a container. More particularly, the present invention directed to the use of a scroll-shaped resilient panel to "roll up" the open end of a container defined by opposed sheets of pliable material.

DESCRIPTION OF THE PRIOR ART

Many products are purchased or stored in bags. For perishable products kept in such bags, or products which can lose certain desirable attributes (e.g., potato chip crispness), it is necessary to create a relatively airtight seal across the opening in the bag, once opened. Various methods for obtaining such a seal after opening a bag include tying a knot in the bag adjacent the opening, using a rubber band to gather the bag together about the opening, using a "twist tie"-type wire or plastic closure to gather the bag about the opening, forming into the bag itself a resealable closure (i.e., a "Ziplock"-type closure) or employing a form of clip or clamp to secure a folded over end of the bag into a closed position. These methods work to a varying degree to close a bag as desired (for freshness, or simply to keep the contents in the bag), but all share one common undesirable attribute—extensive manipulation of the bag or closure device is required in order to effect the desired seal.

The majority of dry breakfast foods are packaged in boxes with an inner bag to contain the dry cereal. Many other foods, commonly called snack foods, are contained in bags without an outer box (e.g., potato chips, peanuts, etc.). The manufacturers of such foods typically seal the bags completely shut after the product has been placed into the bag. Most of these seals are formed by heat sealing or adhesives, depending in part on the material of the bag. These food bags, used for cereals and snack foods, are made of various materials. Typical bag materials include plastic, plastic laminations, plastic and paper, coated plastic or coated paper (i.e., wax paper).

Once the seal at one end of the bag is broken, the bag is not normally resealable other than by mechanically rolling or folding the upper portion of the bag upon itself. For the most part, a suitable closure is not attained when mechanically rolled by human hands, because of the natural tendency of the bag to unroll and thus not seal the contents of the bag from ambient conditions. The open end of the bag must then be tied or clamped in place, using one of the fastening or closure schemes mentioned above.

A closure arrangement is needed that can be used to close the types of bags described above after the original manufacturer's seal has been broken. In addition, an efficient sealing arrangement is desired, one which is efficient both in terms of the time involved by the person closing and sealing the bag, but also economically efficient as well.

SUMMARY OF THE INVENTION

The closure apparatus of the present invention is for use in reclosing an open end of a container, where the open end is defined in part by end edges of first and second opposed sheets of pliable material. The closure apparatus has a closure panel of flexible plastic with opposite inner and outer longitudinal edges. The closure panel has its outer edge spirally wound about its inner edge and is thermally formed to define a coil in lateral section when the panel is in equilibrium. The closure panel is affixed to one of the sheets of the container, and for closing the open end of the container, the end edges of the first and second sheets are captivated within the coil defined by the closure panel.

In a preferred embodiment, a pressure sensitive adhesive is used to affix the closure panel to the container. Preferably, a flange extends from the outer longitudinal edge of the closure panel to accommodate an adhesive and thus facilitate the securing the closure panel to the container. When the container is a bag retained within a box, the closure panel may be affixed to the bag as described above or to an inner wall surface of the box.

To perform the method of closing the open end of a container as defined, the steps would include first providing a panel of resilient plastic which is thermally formed into a scroll, adhering the scroll-shaped plastic panel to the first sheet adjacent the open end of the container, and encasing the first and second sheets within the coils of the scroll-shaped plastic panel. This final step includes unrolling the scroll-shaped plastic panel from its naturally biased coiled state toward a more flattened state, holding the end edges of the first and second sheets of the container adjacent an inner coil surface of the semi-flattened scroll-shaped plastic panel, and allowing the scroll-shaped plastic panel to roll up and resume its naturally coiled state with the end edges of the first and second sheets of the container rolled up within it.

BRIEF DESCRIPTION OF THE DRAWINGS

FIG. 1A (sheet 1) is an end view of the closure apparatus of the present invention.

FIG. 1B (sheet 1) is a pictorial view of the closure apparatus of FIG. 1A.

FIG. 3 (sheet 1) is a pictorial view of a alternative application of the closure apparatus to a bag, wherein the open end of the bag is configured as a pour spout.

FIG. 8 (sheet 7) is a pictorial view of a closure apparatus of the present invention provided with additional longitudinal folds along its coil.

FIG. 9A (sheet 7) is a pictorial view of a closure apparatus of the present invention provided with a plurality of helical folds along its length.

FIG. 9B (sheet 7) is a generated view of the closure apparatus of FIG. 9A, laid flat to illustrate the folds on its coil portion.

FIG. 11 (sheet 9) is a pictorial view of an alternative embodiment of a closure apparatus of the present invention mounted to a bag above the seal at an open end thereof.

FIG. 12A (sheet 9) is an end view of the closure apparatus of the present invention, illustrating the use of barbs to increase the frictional interaction between the inner side of the coil and the sheets of the bag.

DETAILED DESCRIPTION OF THE PREFERRED EMBODIMENTS

Figure 2A:
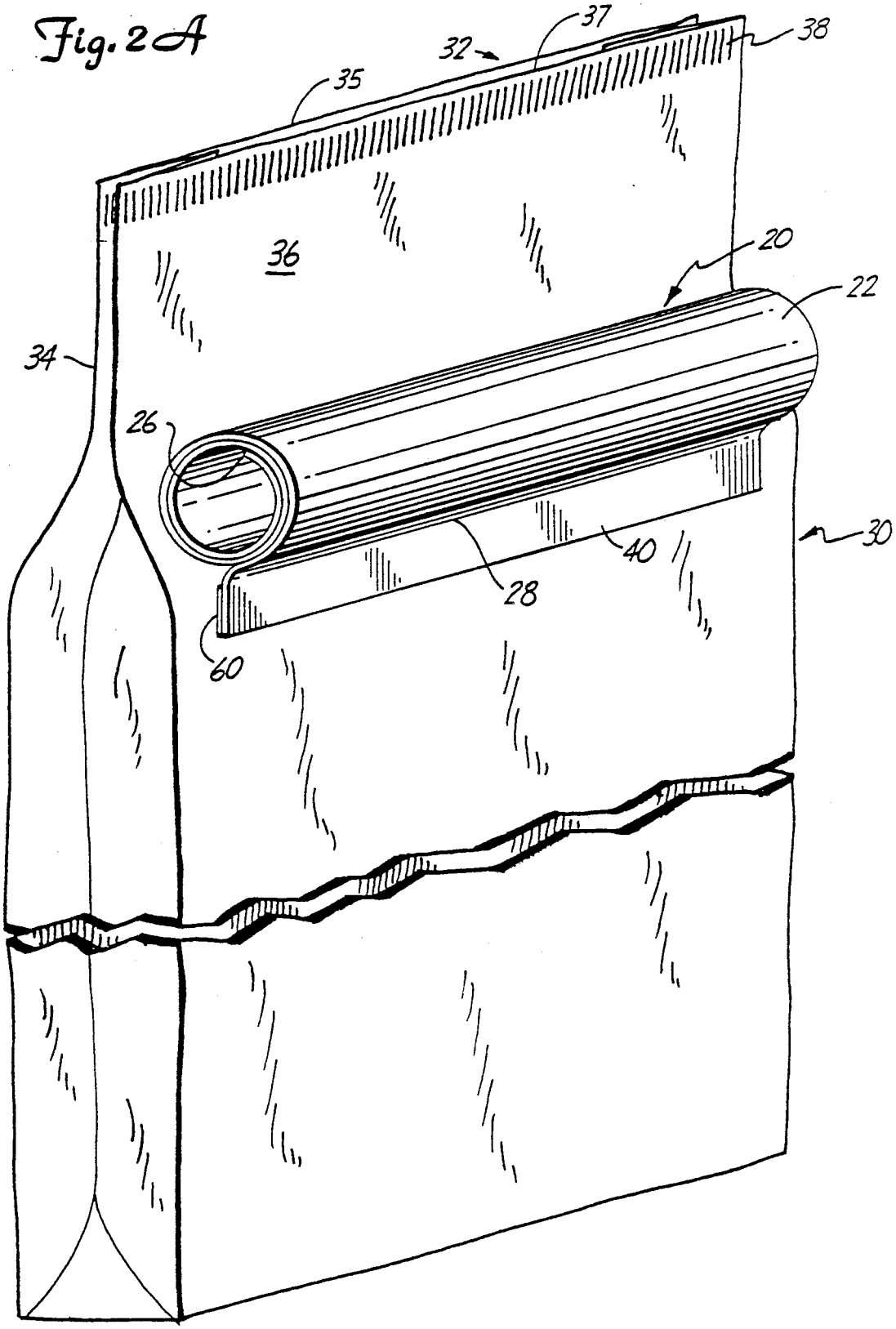
FIG. 2A (sheet 2)is a pictorial of the closure apparatus mounted adjacent the top of a bag.

The present invention is directed to a container closure apparatus, and a method for resealably closing a container, which is quite simple and efficient in design. Multiple embodiments of the invention are shown and described herein, but it should be understood that further variations on the principle and scope of the invention are readily possible, and the illustrations shown and described are for illustrative purposes only. All of the embodiments disclosed herein have the same primary purpose, namely, achieving a resealable closure for a pliable container's open end.

The basic shape of the closure apparatus of the present invention is that of a scroll, or a coiled sheet. This shape is illustrated by closure apparatus 20 in FIGS. 1A and 1B. A sheet or panel 22 of flexible material is coiled along a longitudinal axis (as at 24) and has an inner longitudinal edge 26 and an outer longitudinal edge 28. The panel 22 is spirally-wound a plurality of times about the axis 24, whereby outer longitudinal edge 28 is likewise wound spirally several times about inner longitudinal edge 26.

The panel 22 is biased in a scroll-like formation, as seen in FIGS. 1A and 1B. That is, when the panel 22 is in equilibrium, it defines a coil in lateral cross section, as illustrated in FIG. 1A. As mentioned, the panel 22 is defined by a flexible material, and is preferably formed from a resilient plastic material such as DuPont Mylar. The panel can be so formed by heating, or heat and mechanical deformation, to the basic shape illustrated in FIGS. 1A and 1B. In a preferred embodiment, the panel is formed from Mylar in thickness gauges of 5, 7, 7.5 or 10 mils (1 mil=0.001 inches). Actual closures have been constructed from Mylar sheets of these thicknesses, using both heat and mechanical deformations and heat only deformation. In general, the thicker the Mylar, the stiffer the panel will be. Depending upon the application, variations in stiffness may be desired.

Although the material of the panel can be homogeneous plastic with thermosetting properties such as DuPont Mylar, the use of other plastic materials is also contemplated. As long as the basic feature of resiliency and memory are present so that the coil can be formed as illustrated in FIGS. 1A and 1B and will "recoil" if unrolled or urged to a flattened condition, the material will be suitable for the intended purpose.

Another form of panel material which works in forming the closure apparatus of the present invention is a bilamination of plastics with different coefficiencies of expansion. In other words, the coiled panel is formed from two sheets of plastic laminated together, with the coefficient of expansion of one layer being different from the coefficient of expansion of the other layer. Permanent deformation induced due to heat treatment causes a curvature of the biluminated material, causing the material to roll or scroll in upon itself to the shape seen in FIGS. 1A and 1B.

FIG. 2A illustrates a typical bag application for the closure apparatus 20 of the present invention. A cereal or snack food bag is illustrated at 30, and generally has one open end or side 32. In the case of a bag, this typically is defined by two opposed sheets of pliable material 34 and 36, each of which has an end edge 35 and 37, respectively. When such bags are sold with ingredients therein, a moisture seal is typically provided along that end of the bag to be opened, which in FIG. 2A is illustrated by heat seal 38. In FIG. 2A, the heat seal has been broken and the opposed sheets 34 and 36 are slightly separated. As such, the ingredients of the bag are accessible, but also are not sealed from spillage or exposure to moisture, etc.

By use of the closure apparatus 20 of the present invention in combination with the sheets 34 and 36 of the bag 30, an effective bag seal can be achieved. Closure apparatus 20 is secured to the bag adjacent its outer longitudinal edge 28 by suitable means. In the case illustrated in FIG. 2A, a flange 40 extends radially outwardly from the coil defined by the panel 22. The flange 40 is affixed to the outside of sheet 36 by a pressure sensitive adhesive, heat seal or some other suitable adhesive means. The closure apparatus 20 is mounted to the sheet 36 adjacent the open end 32 of the bag.

Figure 2B:
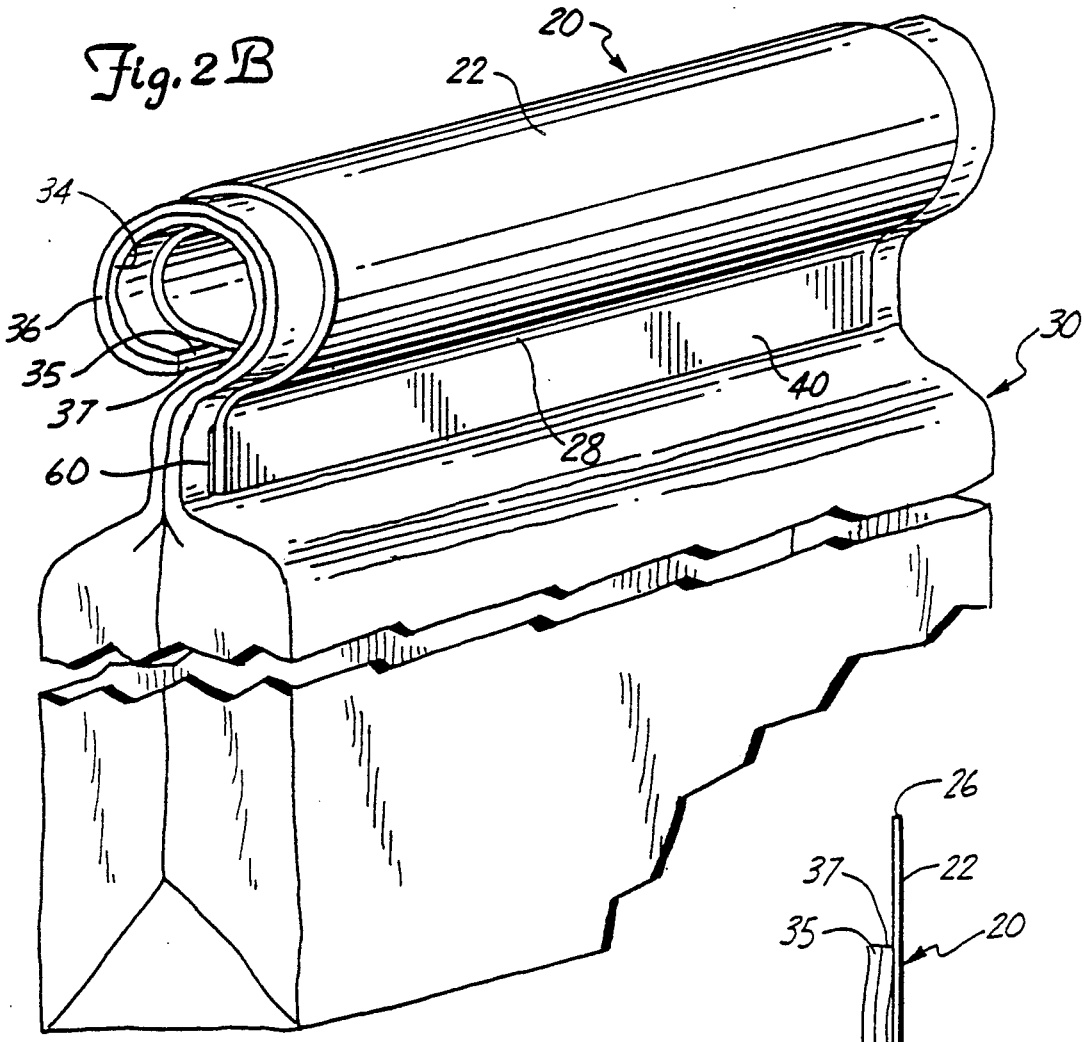
FIG. 2B (sheet 3) is a pictorial view of the closure apparatus coiled about the top end of the bag.
Figure 2D:
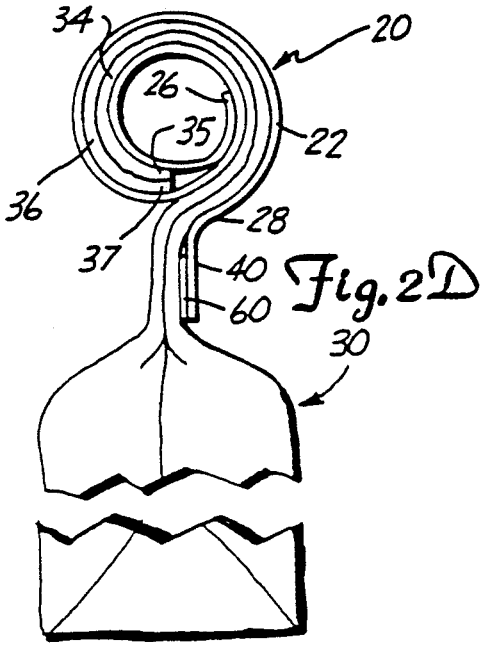
FIG. 2D (sheet 3) is a side view of the closure apparatus coiled about the top end of the bag.
Figure 2C:
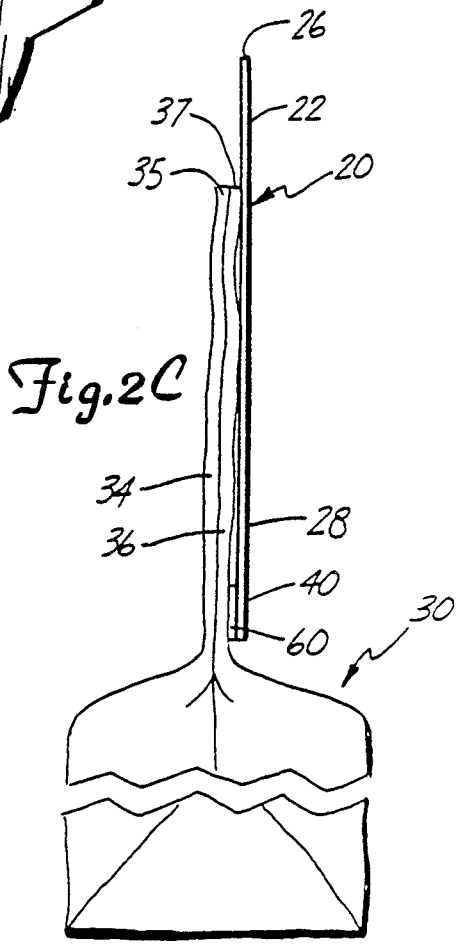
FIG. 2C (sheet 3) is a side view of the closure apparatus mounted on the bag and in a semi-flattened state.

FIG. 2B illustrates the closure apparatus 20 in use to engage and captivate the sheets 34 and 36 within the coil defined by the panel 22. As seen, the longitudinal edges of the panel 22 are aligned generally parallel to the end edges of the sheets 34 and 36. As seen in FIG. 2C, the coil is unrolled so that it lies essentially parallel to the opposed sheets 34 and 36. This is done manually, and once aligned as seen in FIG. 2C, the release of the panel 22 then allows it to resume its equilibrium state of a coil and in the process, gather or captivate the sheets 34 and 36 in a spiral formation, as illustrated in FIG. 2D. The panel 22 rolls up like a window shade, taking the loose ends 35 and 37 of the sheets 34 and 36 with it. In so doing, the sheets 34 and 36 are pressed against one another, thereby closing the open end 32 of the bag and creating a relatively moisture-free and air tight seal across the open end 32 of the bag 30.

To perform the inventive method of closing the open end 32 of a bag-like container 30 (which is defined in part by the end edges 35 and 37 of the first and second opposed pliable sheets 34 and 36, respectively) the scroll-like panel 22 is adhered to the container 30 adjacent its open end 32. The sheets 34 and 36 are then encased within the coils of the scroll-like panel 22. This is done by first unrolling the scroll-like panel 22 of flexible material from its naturally biased coiled state (see FIG. 2A) to a more flattened state (see FIG. 2C). The end edges 35 and 37 of the first and second sheets 34 and 36, respectively, are held adjacent an inner coil surface of the semi-flattened scroll-like panel 22, and the panel 22 is allowed to roll up and resume its naturally coiled state, with the end edges 35 and 37 of the first and second sheets 34 and 36, respectively, rolled up within it, as seen in FIGS. 2B and 2D.

As discussed above and illustrated in FIGS. 2A–2D, the scroll-like panel 22 is affixed to one of the sheets 36 of the bag-like container 30. A preferred means for accomplishing this is to proVide a flange 40 extending from an outer edge 28 of the panel 22, and affixing the flange 40 to the first sheet 36 of the bag-like container 30.

The present invention thus comprises a reusable closure for a bag-like container which can be opened and then can close the container numerous times without appreciable performance (handling and sealing) deterioration. The discussion above and the illustrations of FIGS. 1 and 2 herein present the invention in perhaps its most simple and adaptable form. Numerous modifications are contemplated without departing from the spirit and scope of the invention. For illustrative purposes, some further embodiments are disclosed and discussed herein, but by no means should these be considered to be define the ultimate scope of the invention and claims presented herein.

In one application of the invention, the bag 30 is not completely opened along its heat seal edge 38, but is only partially opened along one end to form a pour spout 42 between opposed material sheets 34 and 36. In this case, a relatively short closure apparatus 20 is employed and affixed to one of the sheets as described. However, the closure apparatus 20 may be canted or tilted to accommodate the shorter opening 42 and to thus envelope as much of the opening as possible within the coil when the sheets 34 and 36 and entrapped therein. Indeed, the bag 30 can even be designed at its end so that it is difficult to separate the sheets 34 and 36 any larger than pour spout 42.

Even if an opening to be closed is longer than the longitudinal length of the closure apparatus, the bag sheet overlap can be folded in and also rolled up within the closure apparatus to achieve an effective closure of the open end of the bag. It can be readily seen that the dimensions of the closure apparatus (longitudinal length, external diameter of coil, number of coils, flange size, etc.) are variable depending upon the application. For example, in FIGS. 2A and 2B, the closure apparatus 20 is not as long as the bag opening 32. However, it is sufficiently long to cover a good proportion of the opening when the sheets 34 and 36 are encompassed within the coil of the closure apparatus 20. In the application of FIG. 3, a shorter closure 20 apparatus is employed, to accommodate the relatively smaller spout opening 42 of the bag-like container 30.

Figure 4A:
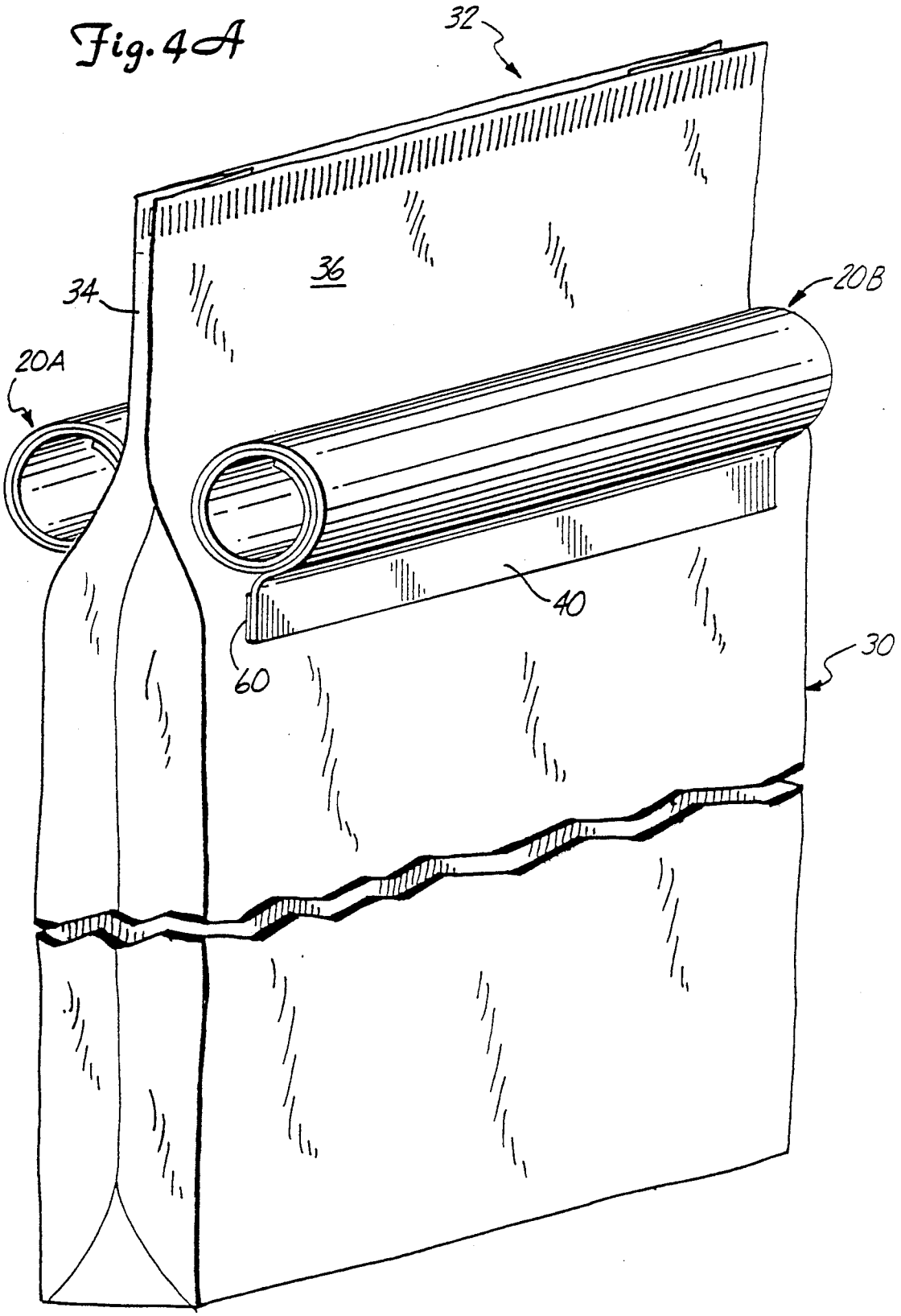
FIG. 4A (sheet 4) is a pictorial view of the bag having two cooperating closure apparatii mounted adjacent the top end of the bag.
Figure 4B:
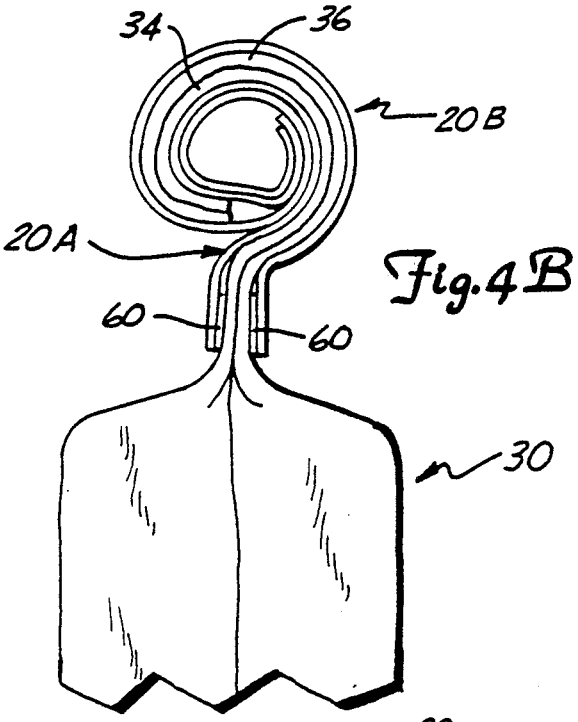
FIG. 4B (sheet 5) is an end view of the two cooperating closure apparatii coiled about the top end of the bag.

In those cases where a more effective and strong seal is desired, a dual closure arrangement is provided, as seen in FIGS. 4A and 4B. In this configuration, closure apparatus 20A is affixed on one side of the bag-like container 30 and closure apparatus 20B is affixed on the other side. As seen in FIG. 4A, the closure apparatii 20A and 20B are aligned on opposite sides of the bag 30, generally longitudinally parallel. In the position shown in FIG. 4A, the open end 32 of the bag 30 is open and accessible. The coils of the closure apparatii 20A and 20B are synchronized (in this case both extending counterclockwise as viewed in FIG. 4B) so that when the coils are forced to a semi-flat and generally parallel position on the bag 30, they will wind up together when released, encompassing the sheets 34 and 36 of the bag 30 therebetween. This effectively closes and seals the open end of 32 of the bag 30. Compare FIG. 4A, where the coils are in their separated relaxed state and the bag opening is open with FIG. 4B, where the coils are in their intertwined relaxed state with the sheets 34 and 36 therebetween, closing the open end 32.

Figure 5:
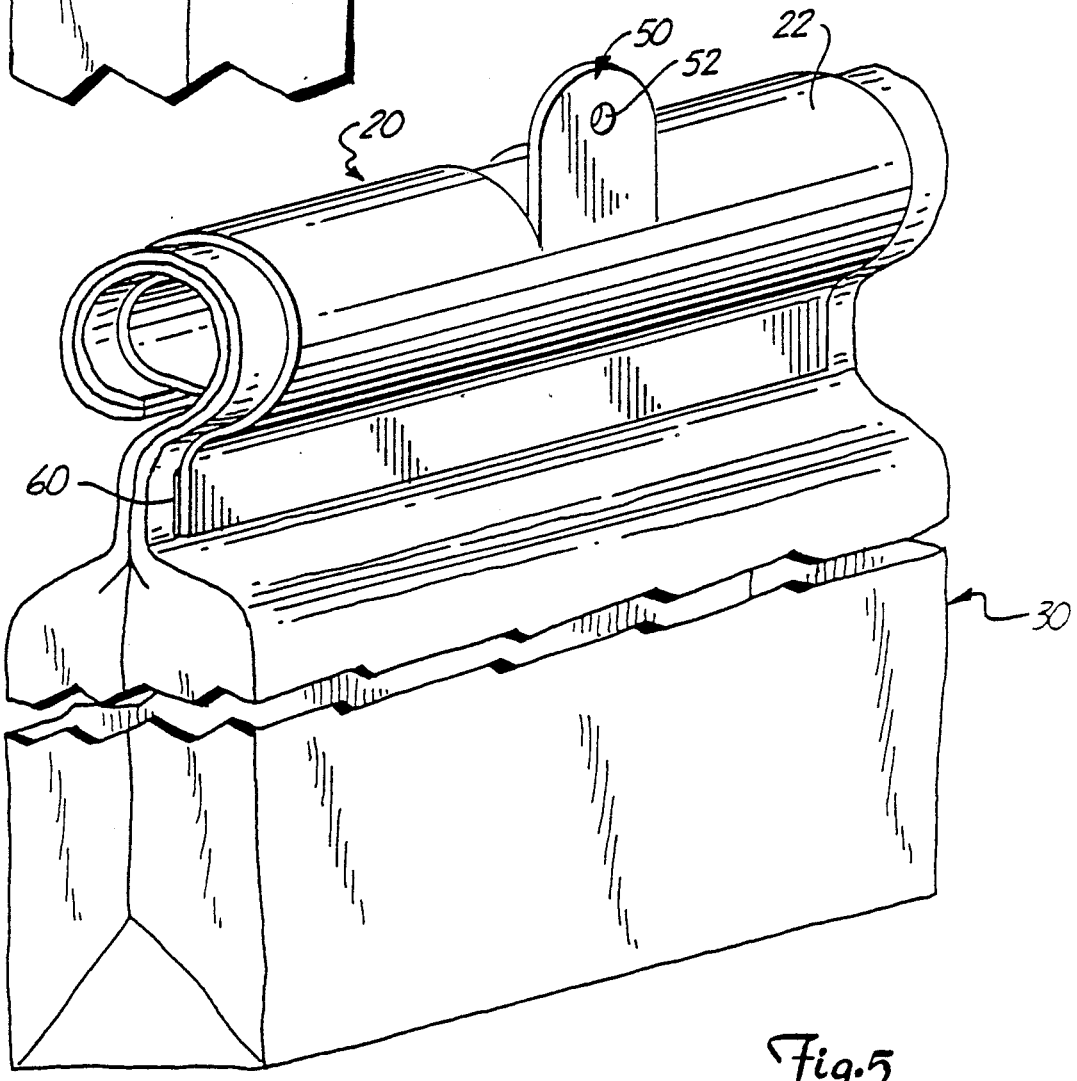
FIG. 5 (sheet 5) is a pictorial view of a closure apparatus of the present invention mounted on a bag and provided with a hang tag.
Figure 6:
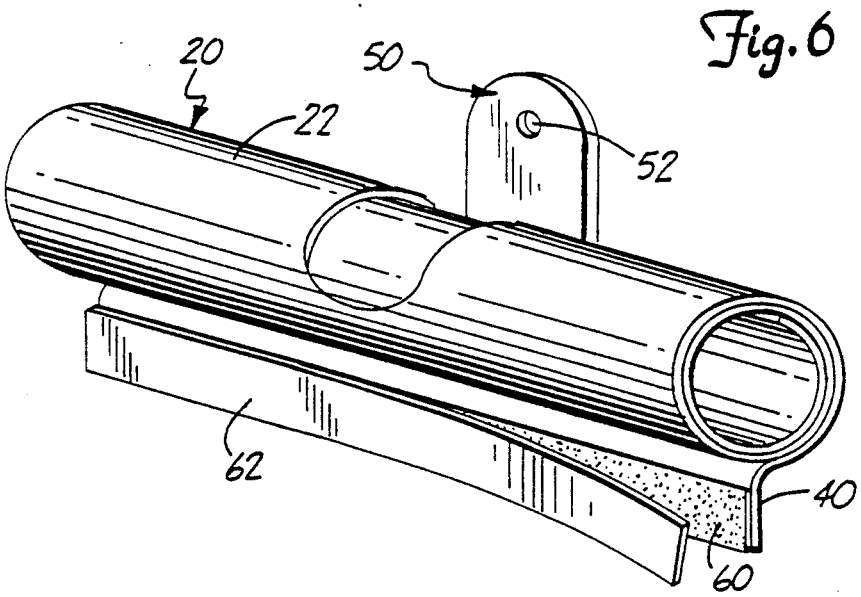
FIG. 6 (sheet 6) is a pictorial view of the closure apparatus of FIG. 5, illustrating the use of a pressure sensitive adhesive on a bag mounting flange thereof.

In another embodiment of the present invention, a tab or hang tag is provided on a closure apparatus 20 of the present invention. As seen in FIGS. 5 and 6, a tab 50 is cut out of the closure panel 22 and preferably not deformed to coil with the rest of the panel 22. Thus, the tab 50 is integral with the panel 22, is upstanding and by forming an aperture 52 therein, the tab 50 can be used to hang the closure apparatus 20 itself, or the closure apparatus 20 and a bag 30 secured thereto (as in FIG. 5). In all other respects, the closure apparatus 20 seen in FIG. 5 is, operates and is configured the same as the closure apparatus 20 of FIGS. 1 and 2.

As seen in FIG. 6 (and also illustrated in phantom in FIG. 1B), a pressure sensitive adhesive 60 applied to an inner side of the flange 40 is activated by peeling away a protective layer 62 therefrom. Once the protective layer 62 is peeled away and disposed of, the adhesive will adhere with pressure to any suitable surface, such as the outer surface of one of the sheets of the bag 30 adjacent its open end 32. Such an adhesive is illustrated in FIGS. 2–5 as at 60. The closure apparatus in this form is marketable to the consumer separate from the bag to be closed (or it can be contained in a cereal box (between box and bag) or it can be put in a snack food bag along with bag contents). When sold separate from the bag, a package of closure apparatii can be marketed and applied to a bag or bags at the consumer's discretion. In this regard, the closure apparatus of the present invention is quite readily adaptable for use in a deli or bakery setting, for closing and sealing bags of food items that are not "factory sealed."

Figure 7:
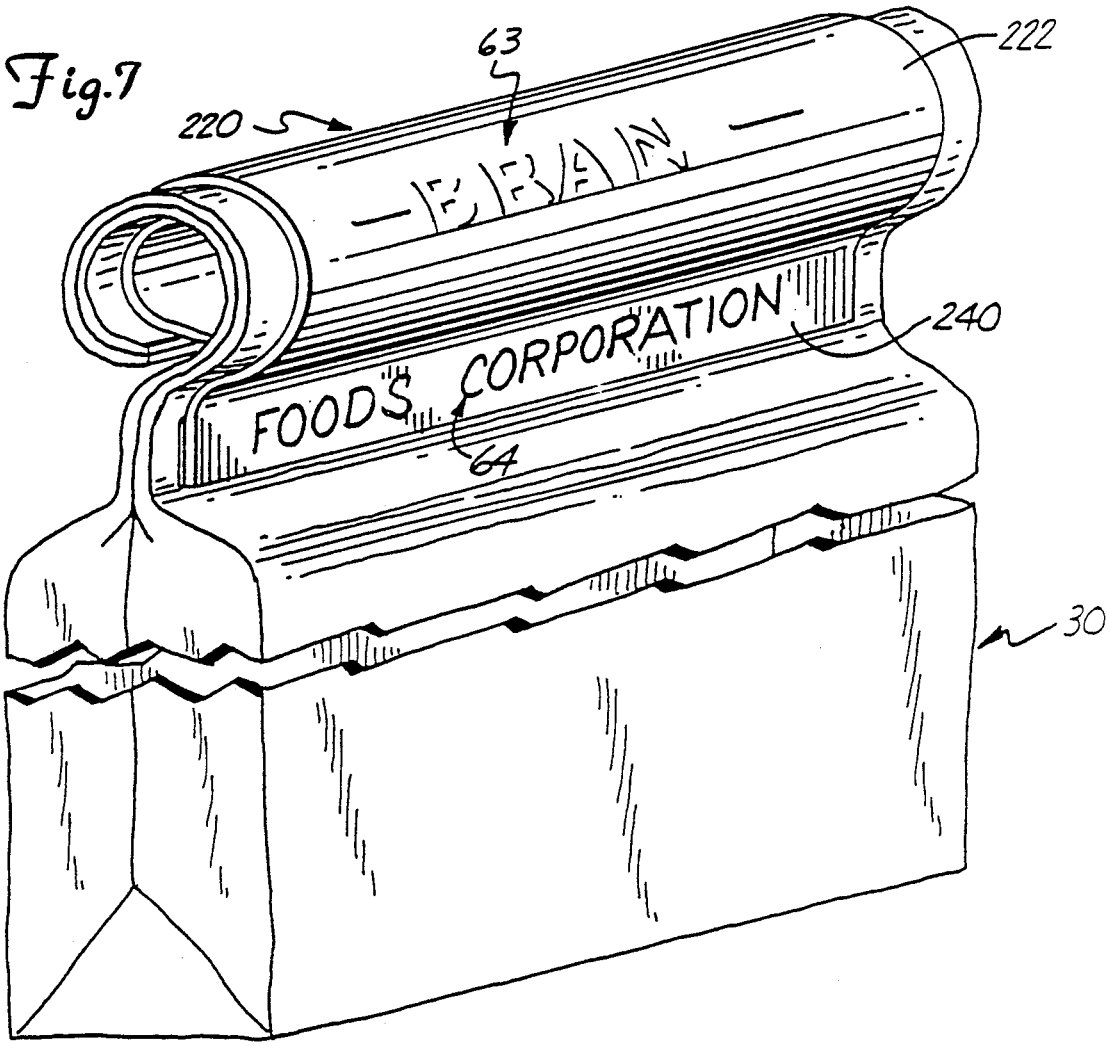
FIG. 7 (sheet 6) is a pictorial view of the closure apparatus of the present invention mounted on a bag, illustrating the use of identifying indicia thereon.

It is contemplated that the closure apparatus of the present invention can be used as a "give away" item to enhance sales of snack foods and/or cereals or other consumable products. As such, to further advance the interests of the promoter or giver, identifying indicia is formed on or printed onto the material defining the closure apparatus. As an illustration of this, FIG. 7 shows a closure apparatus 220 having indicia 63 identifying the contents of the container 30 being sealed ("BRAN") imprinted on its panel 222. This can be done by raised lettering formed during the heat forming process of the panel 222 into its coiled state, or by printing or other means. In addition, indicia 64 relating to the source or promoter of the goods in the container (or the closure apparatus itself) can be printed on the exterior of the panel 222 or on the flange 240 of the panel 222. As illustrated in FIG. 7, the identifying indicia "Foods Corporation" is printed on the flange 240. Of course, other decorative patterns or identifying indicia (e.g., design trademarks) can be formed or printed onto the closure apparatus 220 as well, or instructions for mounting or use can be printed directly onto the closure apparatus 220.

Another embodiment of the closure apparatus of the present invention is illustrated in FIG. 8. In this case, a closure apparatus 320 has a panel 322 which is corrugated longitudinally in a saw-tooth type pattern by folds or ridges in the panel 322. A flange 340 is still provided at an outer longitudinal edge 328 of the panel 322 for mounting the closure apparatus 322 to a container. The longitudinal ridges or saw tooth pattern created by the corrugation effect on the panel 322 serves to provide additional gripping of the opposed sheets of the container when they are within the coil defined by the closure panel 322.

FIGS. 9A and 9B illustrate a further embodiment of the present invention wherein the closure panel is modified to achieve more enhanced gripping of the container sheets. In this case, a helical-type fold or ridge formation is made in the panel, whereby a "screw thread" design is achieved. In this embodiment, a closure apparatus 420 has a panel 422 which has laterally canted folds therein, as seen in FIG. 9A. FIG. 9B illustrates the panel 422 in a generated view, laid flat. By employing a "threaded" fold design in the form of the panel 422 as seen in FIGS. 9A and 9B, the closure apparatus 420 expands in width when rolled with light gauge sheets engaged within the coil defined thereby, which leads to additional clamping action due to the lateral distortion of the panel 422 when it is rolled up upon itself.

To achieve a more positive closure and connection between a closure apparatus 520 having a panel 522 and the sheets encompassed in its coil, a strip of pressure sensitive adhesive 565 is provided adjacent an inner longitudinal edge 526 of the coil of the panel 522. As depicted in FIG. 10 a protective sheet 566 may be provided to cover the adhesive layer 565 until its application is needed.

Figure 10A:
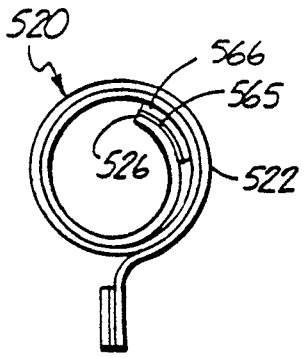
FIG. 10A (sheet 8) is an end view of a closure apparatus of the present invention, illustrating the use of adhesive on an inner surface of the coil thereof.
Figure 10B:
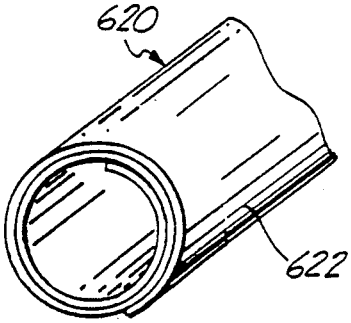
FIG. 10B (sheet 8) is an end view of a closure apparatus of the present invention which has no mounting flange.

In some instances, no mounting flange is necessary or desired adjacent the outer longitudinal edge of the closure apparatus. This type of closure apparatus configuration is illustrated in FIG. 10B, where a closure apparatus 620 is simply defined as a panel 622 completely scrolled upon itself. In use, the closure apparatus 620 of FIG. 10B is simply flattened, its inner coil surface is urged against the sheets, placed with its inner edge next to or beyond the end edges of sheets to be encased, and then released so that the sheets are encompassed within the coil as it rolls up on itself.

Figure 10C:
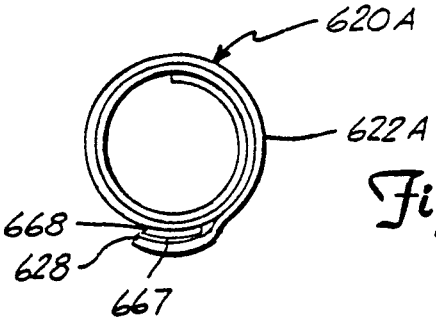
FIG. 10C (sheet 8) is an end view of a flangeless closure apparatus of the present invention, illustrating the use of an adhesive adjacent the outer longitudinal edge of its coil.
Figure 10D:
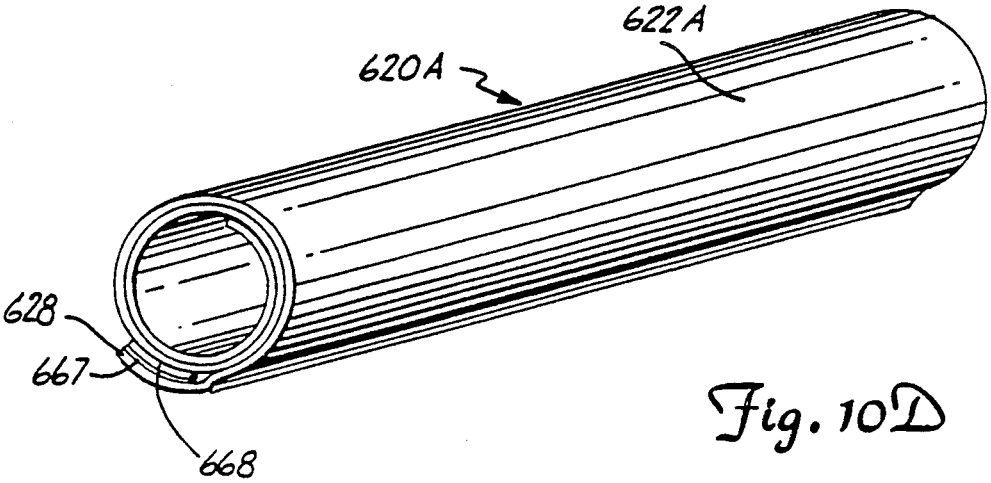
FIG. 10D (sheet 8) is a pictorial view of the flangeless closure apparatus of FIG. 10C.

A further variation on the no-flange closure apparatus design of FIG. 10B is shown in FIGS. 10C and 10D. In this embodiment, a closure apparatus 620A again has no flange adjacent an outer longitudinal edge 628 of its panel 622A. However, a layer of pressure sensitive adhesive 667 and a protective sheet 668 therefor are provided along an inner side of the panel 622A adjacent the outer longitudinal edge 628 of the panel 622A. For some applications where a very affirmative gripping of the sheets is desired, large portions or even the entire inner surface of the panel may be coated with adhesive means. Where a somewhat permanent closure is desired, the protective sheet may be disposed of all together, with the coil itself acting as the protective layer prior to use.

The closure apparatus of the present invention can be provided on a bag-like container by the manufacturer, or can be mounted (such as by pressure sensitive adhesive means) by the consumer. FIG. 11 illustrates an arrangement whereby the closure apparatus 20 is mounted to the bag 30 by the manufacturer above the moisture seal 38 adjacent the end of the bag 30 to be opened. Thus, for the consumer to gain access to the contents of the bag 30, he or she unrolls the closure apparatus 20 to allow separation of the sheets 34 and 36 and breaks apart the sheets at the seal 38. For closing the bag 30, the process is reversed, so that the sheets are again rolled up in the coil of the closure apparatus 20 to effect the moisture-tight seal which is desired.

Figure 12B:
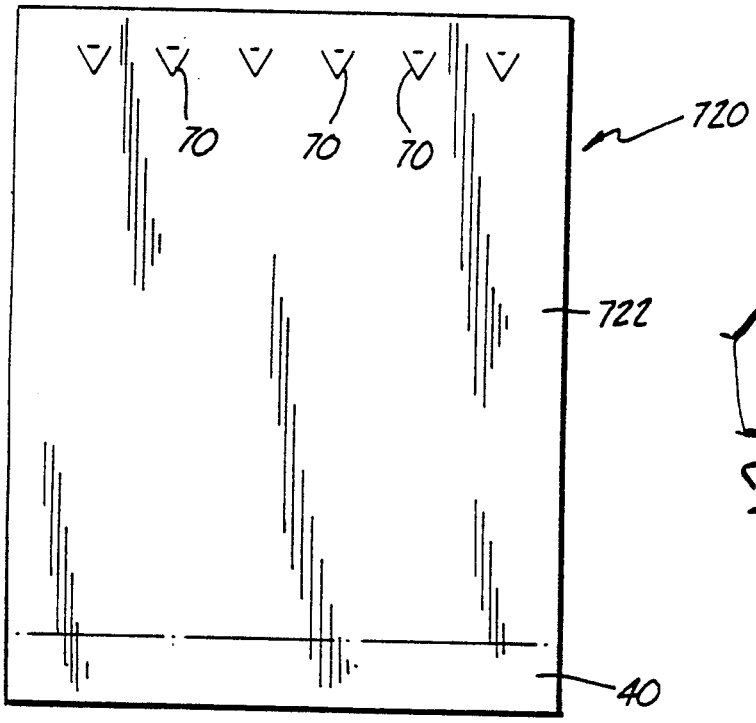
FIG. 12B (sheet 10) is a generated view of the closure apparatus of FIG. 12A, laid flat to illustrate the barbs on its coil portion.
Figure 12C:
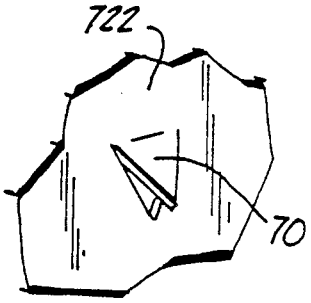
FIG. 12C (sheet 10) is an enlarged pictorial view of one of the barbs on the closure apparatus of FIG. 12A.

A further embodiment of the closure apparatus of the present invention is illustrated in FIGS. 12A, 12B and 12C. In this embodiment, the closure apparatus 720 has a series of darts or barbs formed in its panel 722 therein to aid in engaging and holding the opposed sheets of the bag-like container within the coil of the closure apparatus 720. These barbs are illustrated as barbs 70 in FIGS. 12A, 12B and 12C. For illustrative purposes, FIG. 12B is a generated view of the panel 722 in a flattened state. Preferably, the barbs are integrally formed from the material of the panel 722, as illustrated in FIG. 12C. A closure apparatus with barbs (like FIGS. 12A, 12B and 12C) and the closure apparatii with other ridges or folds (like in FIGS. 8 and 9A) all have enhanced frictional interaction between the coil and the sheets enveloped therein, to effect a better seal.

Figure 13A:
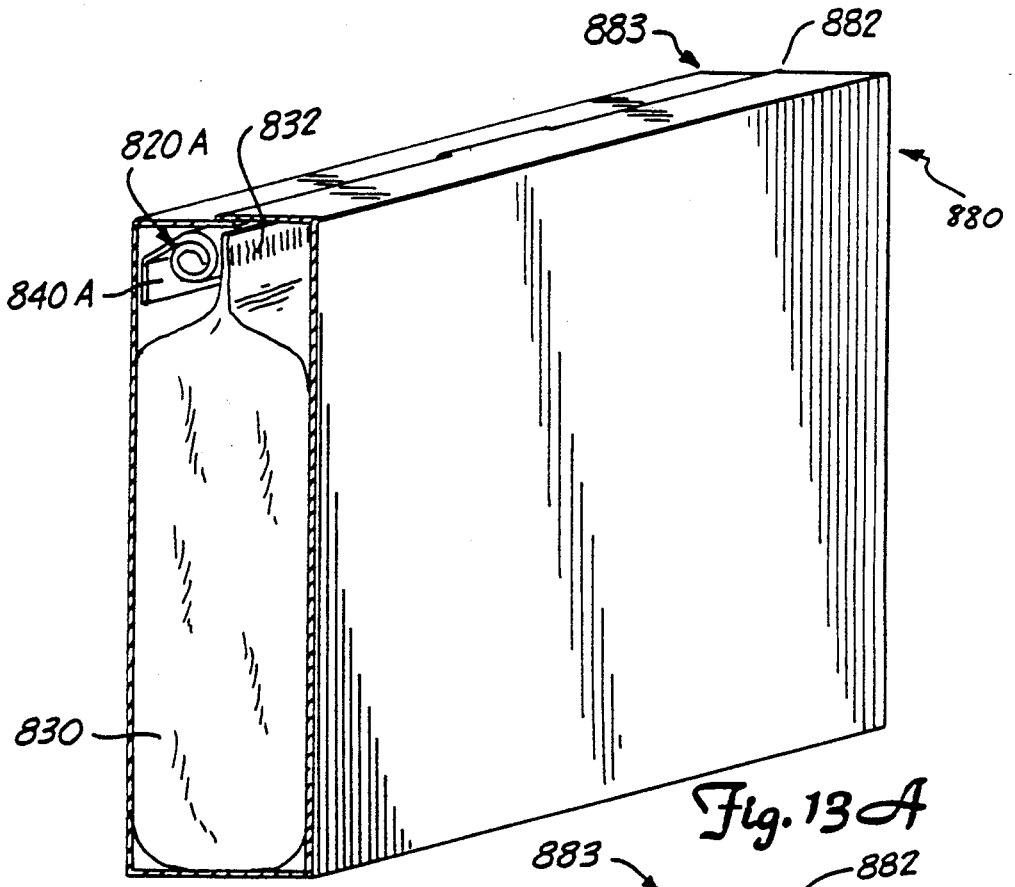
FIG. 13A (sheet 11) is a pictorial sectional view of a cereal box having a closure apparatus of the present invention mounted on a side inner wall surface thereof.
Figure 13B:
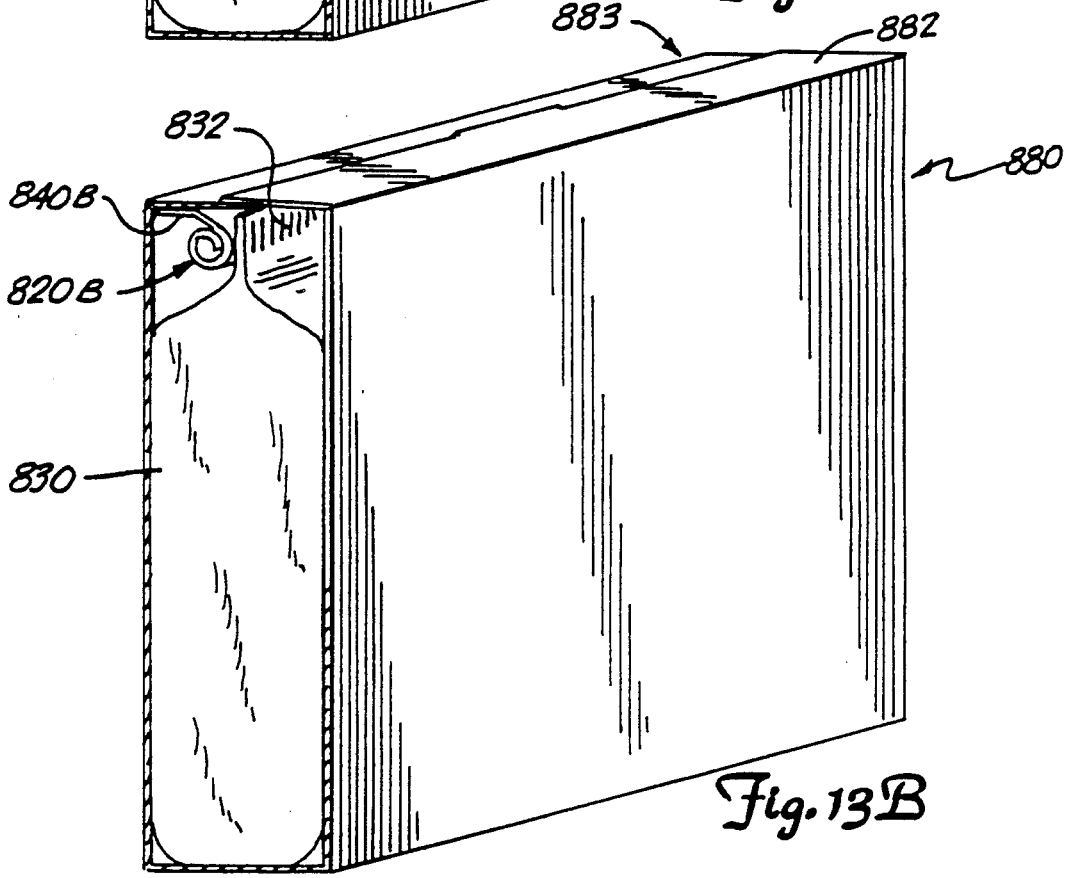
FIG. 13B (sheet shows a pictorial sectional view of a cereal box having a closure arrangement in a box for the closure apparatus of the present invention mounted on a top panel inner wall surface thereof.

In the case of dry cereals, a moisture-tight bag is typically provided within a cardboard box. For this circumstance, the embodiments of the present invention as depicted in FIGS. 13A and 13B are contemplated. That end of a bag 830 in a box 880 which is desired to be opened (end 832) is positioned adjacent interlocking flaps 882 of the box 880 (the "box top" 883). For use in this environment, one embodiment of the present invention provides the closure apparatus be secured to an inner surface of the box. This is accomplished either by adhering a flange 840A of a closure apparatus 820A to a side wall surface (as seen in FIG. 13A) or by adhering a flange 840B of a closure apparatus 820B to a top wall surface (as seen in FIG. 13B). In either event, once the factory seal proximate the end 832 of the bag 830 is broken, the coil of the closure apparatus is then alignable about the sheets defining the open end of the bag to encase those sheets within its coil and thereby create an effective seal to preserve the contents of the bag and keep them crisp. Of course, the closure apparatus also acts to keep the bag mechanically closed to avoid spillage of the contents if the box is tipped over.

The cereal box bag closures of FIGS. 13A and 13B can be affixed to the inside of the box by the manufacturer. In a cereal box environment, the closure apparatus of the present invention can also be simply dropped into the box on top of the factory sealed bag for application and use by the consumer. Alternatively, the closure apparatus can be sealed within the bag itself for use once the factory seal is broken by the consumer. Further, the closure apparatus can also be provided with means for affixing it to the exterior of the bag or to the interior of the box.

Figure 14A:
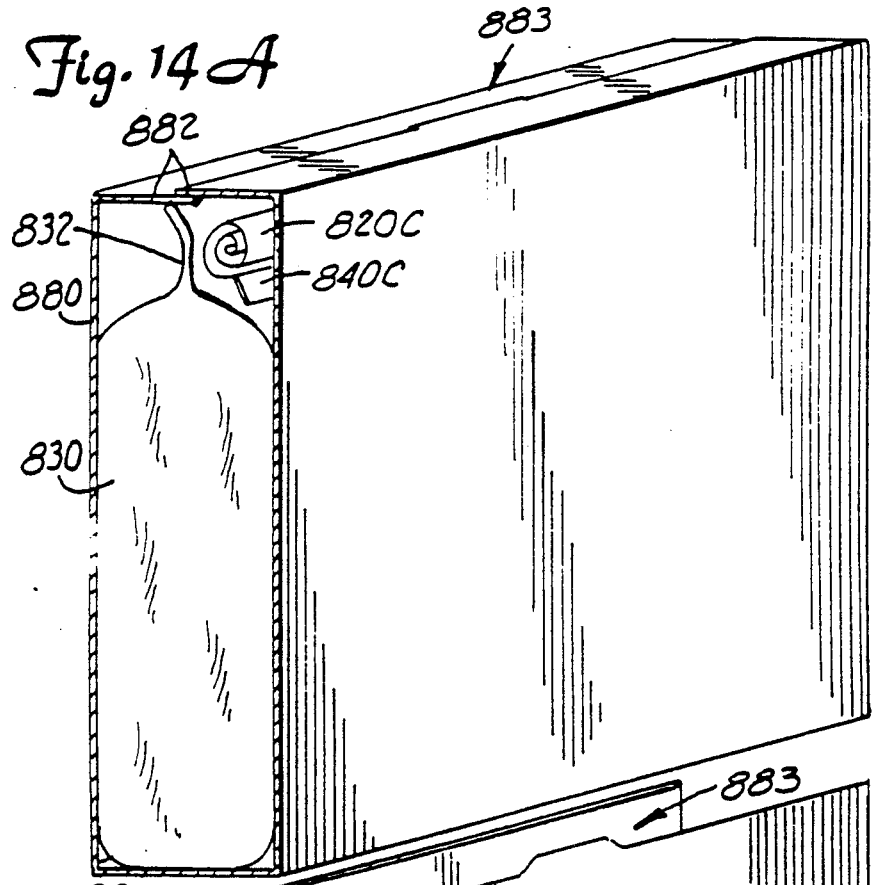
FIG. 14A (sheet 12) is a pictorial sectional view of a cereal box having a closure apparatus deposited therein for application by the consumer to the cereal bag in the box.
Figure 14B:
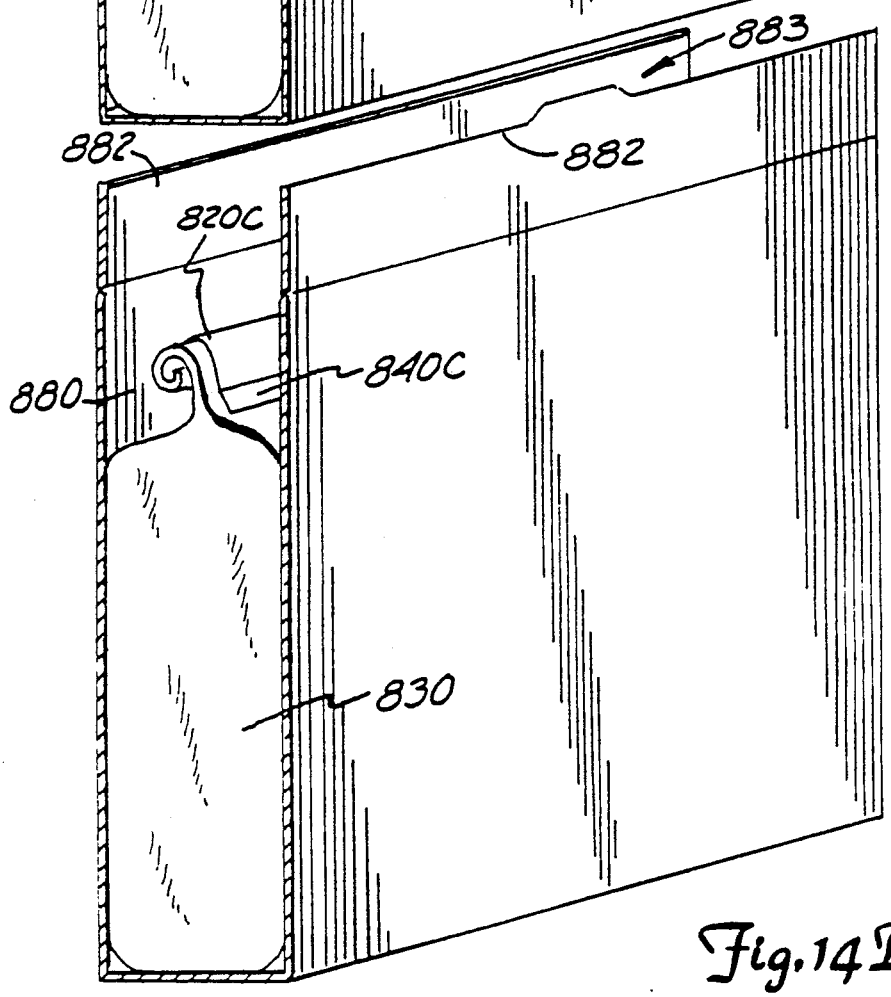
FIG. 14B (sheet 12) is a pictorial sectional view of a cereal box having a closure apparatus of the present invention mounted on the cereal bag in the box.

This alternative is illustrated in FIGS. 14A and 14B. FIG. 14A shows a bag 830' and a box 880' which is closed at its box-top 883'. The box 830' has an openable end 832' adjacent the box-top 883'. Upon assembly of the packaging and product by the manufacturer, the closer apparatus 820C is placed within the box 80 and bag 830 adjacent the box-top 883. The closure apparatus 820 preferably has a flange 840C with a layer of pressure sensitive adhesive thereon which is covered by a protective cover. Thus, once the consumer opens the box-top 883, the closure apparatus 820 can be applied to one of the sheets adjacent the end 832 of the bag 830 by peeling away the protective cover and securing the flange 840C to the bag 830, as seen in FIG. 14B.

As discussed above, a flange extending radially outward from the coil may be desired to accomplish such mounting, and it is contemplated that numerous flange shapes and designs are possible, depending upon the applicable circumstances. For instance, in some applications where a very effective seal is desired, a very wide flange may be provided. In other applications, a triangular flange may be suitable given the constraints of the positioning of the flange on the container to be sealed. Further, the flange may project from the coil at any desired angle (see, e.g., FIGS. 13A and 13B).

Figure 15A:
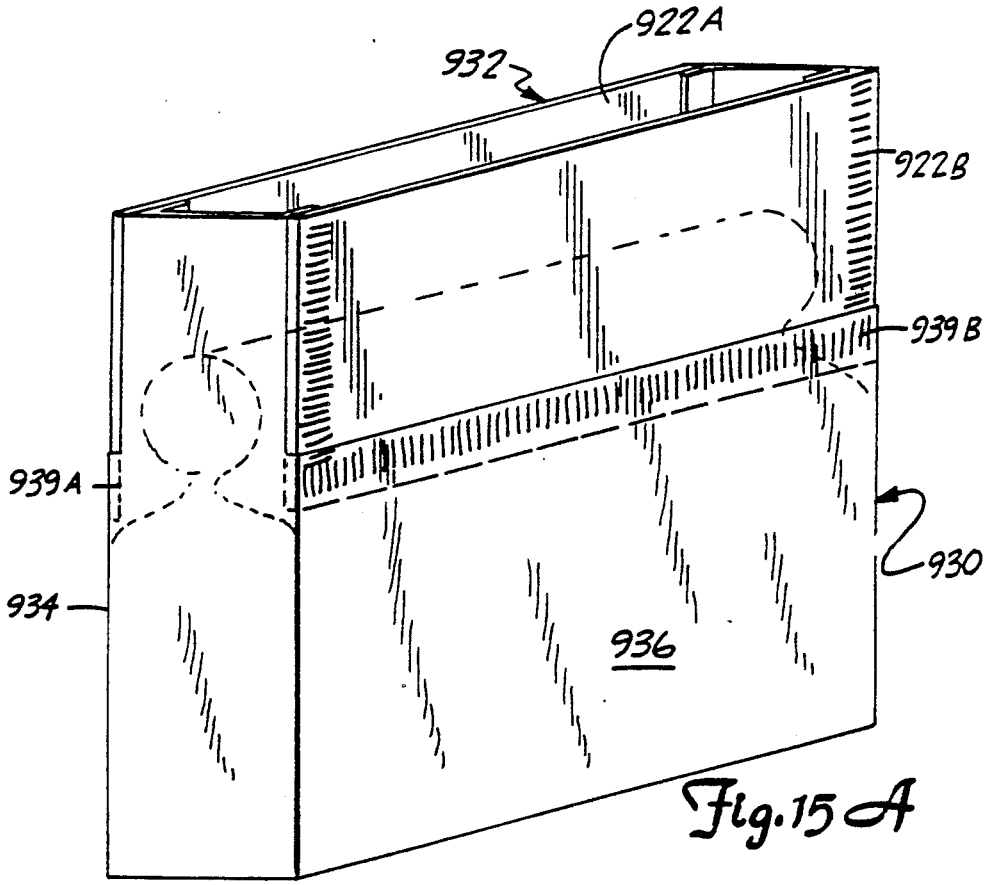
FIG. 15A (sheet 13) is a pictorial view of a bag wherein two opposed closure apparatii are affixed to and are a portion of the bag at its open end.
Figure 15B:
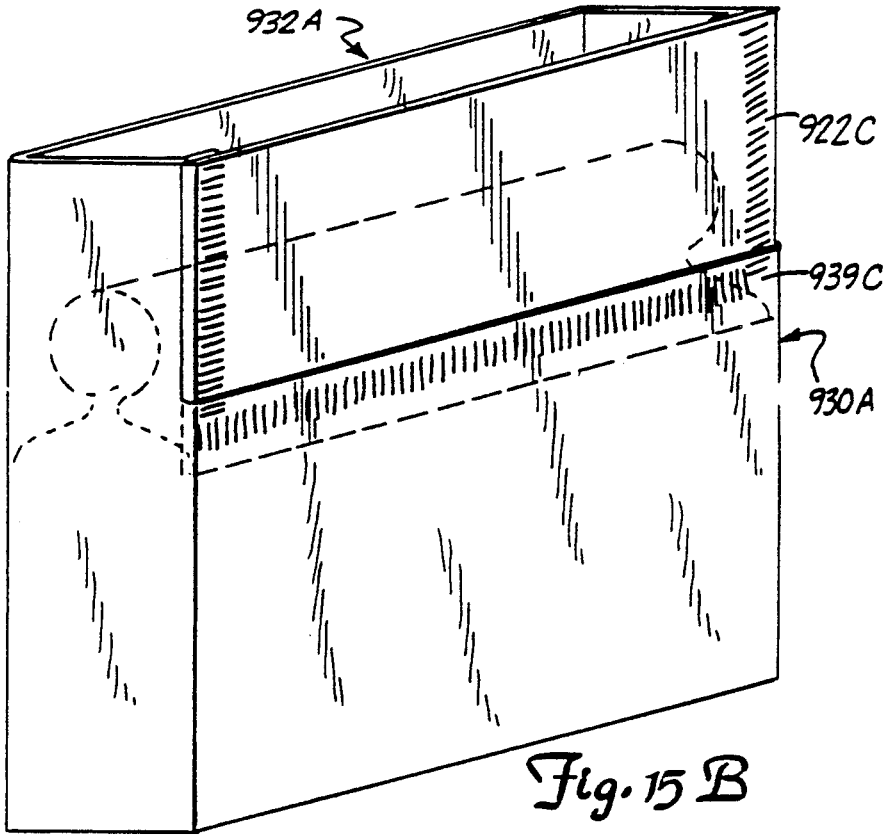
FIG. 15B (sheet 13) is a pictorial view of a bag wherein a closure apparatus is affixed to and is a portion of the bag at its open end.

In one embodiment of the present invention, the closure apparatus itself may define in part one or more of the opposed sheets of the container. This form of closure apparatus is illustrated in FIGS. 15A and 15B. In FIG. 15A, the panels 922A and 922B are shown in generated form (flattened) and opposed to define an open end 932 of a bag 930. The panels 922A and 922B are affixed to the other portions of the bag 930, including the opposed walls 934 and 936 by heat seals or other moisture proof seals 939A and 939B, respectively. In FIG. 14A, the panels 922A and 922B are shown in their naturally biased coiled state in phantom. Again, using two opposed panels requires that the coiling effect of the panels be synchronized (e.g., like shown in FIG. 4B). To achieve access to the interior of the bag 930, panels 922A and 922B are unscrolled or unrolled to define the opening 932. The closure apparatus, as defined by the opposed panels 922A and 922B, is thus integral with the bag 930 itself.

In FIG. 15B, only one coiled panel 922C is employed. In this arrangement, the panel 922C is affixed to the other portions of a bag 930A by heat seal means 939C, thus creating a somewhat integral bag-closure apparatus construction. Again, the panel 922C is shown in its naturally biased coiled state in phantom in FIG. 15B.

This integral bag-closure apparatus construction may be best achieved by means of bilamination of plastics technique, as discussed above. In this form, the bag is formed entirely from a plastic material having one coefficient of thermal expansion. Then, a sheet of a second plastic material having a different coefficient of expansion is adhered to one or both sheets of the bag adjacent its designated open end. The entire bag product is heat treated and as a result, the difference in expansion coefficients of the biluminated plastic sheets cause the sheet(s) at the open end of the bag to curl, thereby forming the closure apparatus of the present invention.

Figure 16:
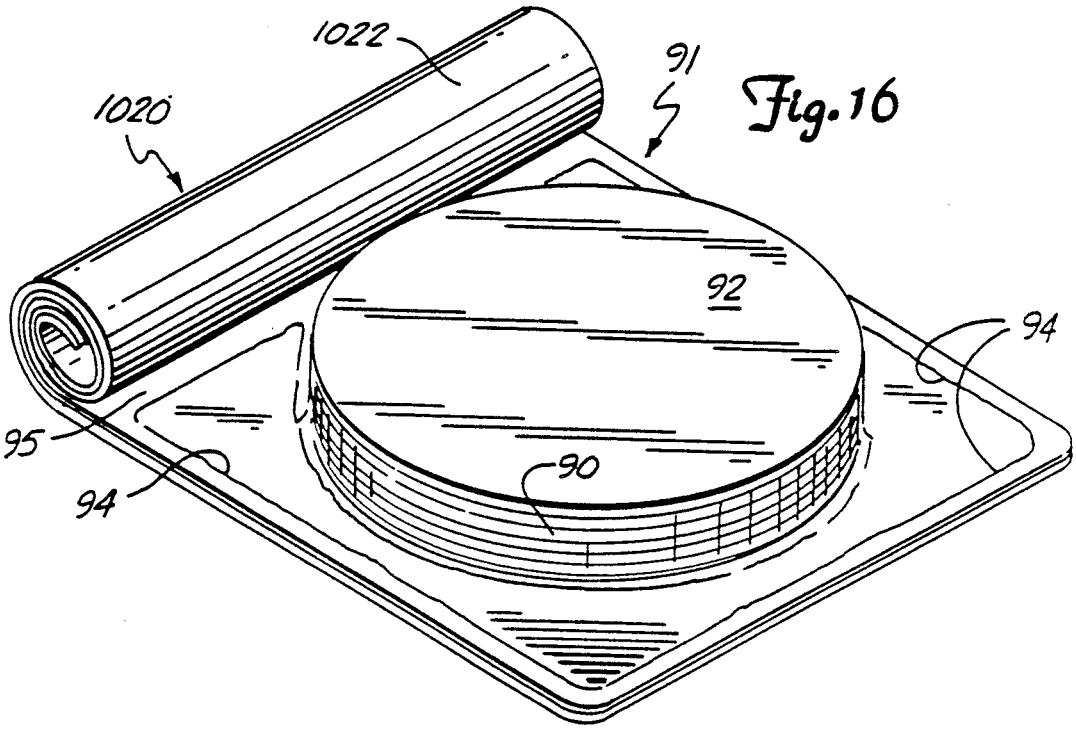
FIG. 16 (sheet 10) is a pictorial view of a further embodiment of the closure apparatus of the present invention, illustrating its use on a package back such as cold cuts of meat, cheese or snack foods.

A final illustrative embodiment of the invention is illustrated in FIG. 16. The moisture sealing technique of the present invention is applicable in many different environments. FIG. 16 shows its use in connection with a "cold cuts" type package 91 which is commonly used to sell sliced meat products and cheeses as consumer items. The food items (indicated generally as at 90) are encased within a clear plastic cover 92, typically mounted on a plastic backing which is then provided with a hang tag and aperture at one end for hanging the package on a point-of-sale rack. A thermal seal is usually provided between the clear cover and the backing, entirely around the food items 90 to ensure freshness and seal the food items 90 from exposure to contaminants. In FIG. 16, this seal is indicated generally as seal 94. With one side of the seal being typically broken, as at 95, for access to the food items 90, thereby creating an opening at one end of the package 91.

A closure apparatus 1020 is affixed to or integral with the backing of the package 91 to extend across the opening end of the package, as seen in FIG. 16. The coil of the closure apparatus 1020 is defined by a flexible scroll-like panel 1022, preferably formed of Mylar. The plastic cover 92 extends beyond the end seal 95 a distance sufficient to be effectively trapped within the coil of the panel 1022 to create an air-tight seal. To withdraw one or more of the meat or cheese slices in the package 91, the panel 1022 is unrolled sufficiently to separate the plastic cover 91 from the coil and backing past seal 95, to permit access to the food items 90. To reseal the package 91, the coil is flattened, the end flap of the plastic cover 92 is laid against the inner side of the flattened panel 1022 and the panel 1022 is allowed to recoil about itself and the end extending portion of the plastic cover 92.

In all its various embodiments, the closure apparatus of the present invention provides an extremely easy-to-use closer for a bag-like container which is efficient both in use and in manufacture. The invention is beautifully simple in design, which makes it easy to manipulate, even with only one hand. Because of its simplicity, the closure apparatus of the present invention is quite economical to make. Its design and method of use allow a nearly perfect crispness seal to be made again and again on a bag-like container, an advantage previously unattainable in the closure field with such a simple design.

Although the present invention has been described with reference to preferred embodiments, workers skilled in the art will recognize that changes may be made in form and detail departing from the spirit and scope of the invention.

What is claimed:

1. A packaging system for spoilable or loose material comprising:

a bag-like container having an openable end which is defined in part by end edges of first and second opposed sheets of pliable material;

a closure apparatus for holding closed the open end of the bag-like container, the closure apparatus being defined by a closure panel of flexible plastic which has a first portion and a second portion, the first portion having opposite inner and outer longitudinal edges, the outer edge spirally wound about the inner edge and being thermally formed to define a coil when the closure panel is in equilibrium and the second portion being generally planar when the closure panel is in equilibrium; and adhesion means for selectively affixing the second portion of the closure panel to the first sheet of the container, so that, for closing the open end of the bag-like container, the end edges of the first and second sheets can be captivated within the coil defined by the first portion of the closure panel.

2. The packaging system of claim 1 wherein the adhesion means is a pressure sensitive adhesive.

3. The packaging system of claim 1 wherein the adhesion means is a heat-generated bond.

4. The packaging system of claim 1 wherein the second portion if a flange extending from the outer longitudinal edge of the first portion of the closure panel and wherein the adhesion means is on the flange, whereby the flange is affixed to the first sheet of the container.

5. The packaging system of claim 1 wherein the closure panel is formed from a homogeneous plastic.

6. The packaging system of claim 5 wherein the plastic is Mylar or a similar plastic.

7. The packaging system of claim 1 wherein when placed side-by-side, the end edges of the first and second sheets define a container open end length, and wherein the closure panel's longitudinal length is less than the container open end length.

8. The packaging system of claim 1 wherein the end edges of the sheet and outer edges of the closure panel are aligned generally parallel.

9. The packaging system of claim 1 wherein the closure panel is a first closure panel which is affixed to the first sheet, and further comprising:

a second closure panel of flexible plastic which has a first portion and a second portion, the first portion having opposite inner and outer longitudinal edges, with said outer edge spirally wound about said inner edge and being thermally formed to define a coil when the second closure panel is in equilibrium and the second portion being generally planar when the second closure panel is in equilibrium; and adhesion means for selectively affixing the second portion of the second closure panel to the second sheet of the container, so that for closing the open end of the container, the end edges of the first and second sheets can be captivated between and within the coils defined by the first portions of the first and second closure panels.

10. The packaging system of claim 1, and further comprising:

integral tab means projecting from an outer surface of the closure panel, with the tab means having an aperture therein to facilitate hanging of the closure panel and a container affixed thereto.

11. The packaging system of claim 1, and further comprising:

indicia means mounted on an outer visible surface of the closure panel for providing information regarding the closure panel and/or the container.

12. The packaging system of claim 1, and further comprising:

pressure sensitive adhesive means on an inner coil surface of the closure panel for effecting a better seal of the open end of the container.

13. The packaging system of claim 12 wherein the adhesive means is positioned only adjacent the inner longitudinal edge of the closure panel.

14. The packaging system of claim 1 wherein there is a frictional interaction between the sheets and the coil when the sheets are captivated within the coil, and further comprising:

means for increasing the frictional interaction between the first portion of the closure panel and the first and second sheets of the container therein.

15. The packaging system of claim 14 wherein the means for increasing the frictional interaction comprises:

a plurality of barbs projecting from an inner coil surface of the closure panel.

16. The packaging system of claim 1 wherein the closure panel of flexible material has a plurality of longitudinal folds therein about its coil.

17. The packaging system of claim 1 wherein the closure panel of flexible material has a plurality of helical folds extending around its coil between its inner and outer edges.

18. A packaging system for spoilable or loose material comprising:

a box-like container;

a bag-like container having an openable end which is defined in part by end edges of first and second opposed sheets of pliable material and which is retained in the box-like container;

a closure apparatus for holding closed the open end of the bag-like container, the closure apparatus defined by a closure panel of flexible plastic having opposite inner and outer longitudinal edges, the closure panel having its outer edge spirally wound about its inner edge and being thermally formed to define a coil in lateral section when the closure panel is in equilibrium; and adhesion means for selectively affixing the closure panel to an inner wall surface of the box-like container so that, for closing the open end of the bag-like container, the end edges of the first and second sheets can be captivated within the coil defined by the closure panel.

19. The packaging system of claim 18 wherein the adhesion means is a pressure sensitive adhesive.

20. The packaging system of claim 18 wherein the closure panel has a flange extending from its outer longitudinal edge and wherein the adhesion means is on the flange, whereby the flange is affixed to the inner wall surface of the box-like container.

21. The packaging system of claim 18 wherein the closure panel is formed from a homogeneous plastic.

22. The packaging system of claim 21 wherein the plastic is Mylar or a similar plastic.

23. The packaging system of claim 18, and further comprising:

pressure sensitive adhesive means on an inner coil surface of the closure panel for effecting a better seal of the open end of the bag-like container.

24. The packaging system of claim 18 wherein there is a frictional interaction between the sheets and the coil when the sheets are captivated within the coil, and further comprising:

means for increasing the frictional interaction between the coil of the closure panel and the first and second sheets of the bag-like container therein.

25. In combination with a container having an open end defined in part by first and second opposed sheets of pliable material, a closure apparatus for holding the open end in a closed position which comprises:

a coiled sheet of resilient plastic having an outer coil edge and an inner coil edge; and adhesion means for selectively securing the outer coil edge to an outer surface of the first sheet adjacent the open end, whereby for sealing the open end of the container, the end edges of the first and second sheets can be captivated within the coils of the coiled sheet between its inner and outer coil edges, and for convenient access through the open end of the container, the end edges of the first and second sheets can be external from the coils of the coiled sheet.

26. A packaging system for spoilable or loose material which comprises:

a box-like container having an openable box-top;

a bag-like container within the box-like container, the bag-like container having an openable end adjacent the box-top which is defined in part by end edges of first and second opposed sheets of pliable material; and a closure panel for holding closed the open end of the bag-like container, the closure panel being defined by a sheet of flexible plastic having opposite inner and outer longitudinal edges, the closure panel having its outer edge spirally wound about its inner edge and being thermally formed to define a coil in lateral section when the closure panel is in equilibrium, the closing panel having a flange extending from its outer longitudinal edge and having adhesion means on the flange for selectively securing the flange of the closure panel to an inner wall surface of the box-like container adjacent its box-top whereby the end edges of the first and second sheets of the bag-like container can be captivated within the coil defined by the closure panel.

27. A packaging system for spoilable or loose material which comprises:

a box-like container having a openable box-top;

a bag-like container within the box-like container, the bag-like container having an openable end adjacent the box-top which is defined in part by end edges of first and second opposed sheets of pliable material; and a closure panel for holding closed the open end of the bag-like container, the closure panel being defined by a sheet of flexible plastic having opposite inner and outer longitudinal edges, the closure panel having its outer edge spirally wound about its inner edge and being thermally formed to define a coil in lateral section when the closure panel is in equilibrium, the closing panel having a flange extending from its outer longitudinal edge and having adhesion means on the flange for selectively securing the flange of the closure panel to the first sheet of the bag-like container adjacent its openable end, whereby for sealing the open end of the bag-like container, the end edges of the first and second sheets of the bag-like container can be captivated within the coil defined by the closure panel, or for convenient access through the open end of the bag-like container, the end edges of the first and second sheets can be external from the coil defined by the closure panel.

* * * * *

UNITED STATES PATENT AND TRADEMARK OFFICE

CERTIFICATE OF CORRECTION

PATENT NO. : 4,997,104

DATED : March 5, 1991

INVENTOR(S) : Russell A. Pohl

It is certified that error appears in the above-identified patent and that said Letters Patent is hereby corrected as shown below:

Col. 11, line 20, delete "if", insert --is--.

Col. 11, line 34, delete "sheet", insert --sheets--.

Signed and Sealed this

Twenty-first Day of July, 1992

*Attest:*

DOUGLAS B. COMER

*Attesting Officer*

*Acting Commissioner of Patents and Trademarks*